US006555788B1

(12) United States Patent
Uhl

(10) Patent No.: US 6,555,788 B1
(45) Date of Patent: Apr. 29, 2003

(54) SYSTEM FOR IGNITION AND ION FLOW MEASUREMENT AND ION FLOW GLOW PLUGS FOR THIS SYSTEM

(75) Inventor: Günter Uhl, Helmstadt-Bargen (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/396,383

(22) Filed: Sep. 15, 1999

(30) Foreign Application Priority Data

Sep. 15, 1998 (DE) ..... 198 42 148

(51) Int. Cl.[7] ..... F23Q 7/00
(52) U.S. Cl. ..... 219/270; 123/145 A
(58) Field of Search ..... 219/270, 544; 123/145 A, 145 R; 361/264–266

(56) References Cited

U.S. PATENT DOCUMENTS

| | | | | |
|---|---|---|---|---|
| 5,922,229 A | * | 7/1999 | Kurano | 219/270 |
| 6,150,634 A | * | 11/2000 | Haussner et al. | 219/270 |
| 2001/0050275 A1 | * | 12/2001 | Uhl | 219/270 |

FOREIGN PATENT DOCUMENTS

| | | | |
|---|---|---|---|
| DE | 39 01 545 | | 8/1990 |
| DE | 199 03 224 | | 8/1999 |
| DE | 29913019 | * | 10/1999 |
| EP | 834 652 | | 4/1998 |
| JP | 10-77945 | * | 3/1998 |
| JP | 11-248156 | * | 9/1999 |
| JP | 2000-146180 | * | 5/2000 |

* cited by examiner

*Primary Examiner*—John A. Jeffery
(74) *Attorney, Agent, or Firm*—Nixon Peabody LLP; David S. Safran

(57) ABSTRACT

An ion flow measurement glow plug with an electrical terminal for the ignition current of a heating element which is located in a glow tube on an end which is directed to the combustion space of an engine block. The glow tube is located in a plug housing, insulated relative to the latter, and the plug housing is electrically connected to the engine block. At a terminal-side area of the plug, a solid-state switch is integrated or modulalry arranged, which is triggered by a control signal, as a result of which the second terminal of the heating element is switched to the engine block (ground) via the plug housing.

7 Claims, 12 Drawing Sheets

SYSTEM FOR IGNITION AND ION FLOW MEASUREMENT AND ION FLOW GLOW PLUGS FOR THIS SYSTEM

BACKGROUND OF THE INVENTION

1. Field of the Invention

The present invention relates to ion flow glow plugs and systems for ignition and ion flow measurement using such glow plugs.

2. Description of Related Art

Ion flow measurement in the combustion space of a cylinder delivers various data on the progress of combustion. In an engine with several cylinders, this ion flow measurement can be taken in one, in several or in all cylinders. A system for ignition and ion flow measurement requires special glow plugs and a special control device which, as before, controls not only the ignition process, but also makes available an auxiliary voltage $U_H$ which can be applied to the glow plugs and takes the ion flow measurement. The glow plugs must be made such that, at least in the area of the glow plug tips, they represent a measurement electrode to which an auxiliary voltage $U_H$ can be applied. This voltage is then between the electrode and the inside wall of the cylinder. If at this point ions are produced by the combustion process, current flows. Its behavior allows conclusions regarding the combustion process in the cylinder. Preferably, the glow plug is made such that parts of the heater projecting into the cylinder can also be used as an electrode. That is, the heater and electrode are electrically coupled to one another.

For purposes of explanation, in the following, a system from the prior art is described using FIG. 1, the reference numbers having the following meaning:

(1) Glow plug with electrically insulated heater
(2) Electrode for ion flow measurements, can be made as a closed tube and can contain a heater (3)
(3) Heater, on one side electrically connected anywhere to the electrode (2)
(4) Plug body, electrically insulated relative to the electrode (2)
(5) Electrical insulation
(6) Electrical terminal, heavy current contact
(7) Solid-state switch, for example, n-channel MOS-FET transistor
(8) Voltage evaluation circuit
(9) Ground connection of the plug body (4) to the engine block
(10) Control device
(11) Supply voltage terminal $U_B$, power feed
(12) Ground terminal, power removal
(13) Glow plug terminal, current to the glow plug
(14) Glow plug terminal, current return from the glow plug
(15) Control unit
(16) Switching stage for ignition current $I_{GK}$
(17) Switching stage for ion flow measurement
(18) Control signal for "ignition" function
(19) Control signal for "ion flow measurement" function
(20) Auxiliary voltage generation $U_H$ A prior art bipolar ion flow measurement glow plug has the following features, as shown in FIG. 3:

Glow plug with 2 electrical terminals (6)

The electrode (2) and heater (3) are electrically insulated relative to the engine block by the plug body (4) which contains an insulating element (5)

The electrode (2) is connected anywhere to one of the two terminals of the heater (3)

The ignition current flows via the two electrical terminals (6)

For ion flow measurement the auxiliary voltage $U_H$ is applied to one of the two terminals (6), the other terminal remains unwired.

A previously known, conventional system (FIG. 1) has a number $N_z$ of glow plugs (1) and a control device (10); $N_z$ is the number of cylinders of the respective engine. To be able to use one, several or all $N_z$ glow plugs (1) for ion flow measurement, special ion flow measurement glow plugs are needed in which the electrode (2) and the heater (3) are electrically insulated with respect to plug body (4). These glow plugs have two electrical terminals (6) with which the glow plugs are connected to a control device (10).

The control device (10) contains a control unit (15) which controls all functions; preferably, a microprocessor is used here. $N_z$ glow plugs (1) can be connected to the control device (10). For each glow plug (1), there is a switching stage for the ignition current $I_{GK}$ (16) and in addition, when the ion flow is to be measured with the glow plug, there is a switching stage for ion flow measurement (17). Each glow plug (1) which is also used for ion flow measurement is connected via two terminals (13) and (14) to the two switching stages (16) and (17). Each switching stage is triggered by a control signal for the "ignition" (18) function or a control signal for the "ion flow measurement" (19) function. During ion flow measurement, the "ignition" function is inactive. The switching stage (16) separates the glow plug (1) galvanically from the supply voltage terminal (11) and the ground terminal (12); at the same time, an auxiliary voltage $U_H$ for ion flow measurement is applied via the switching stage (17) to the glow plug (1) connected as a measurement electrode, and the ion flow measurement is taken.

During the ignition process, the current $I_{GK}$ flows through each switching stage (16) and each glow plug (1). For the circuit shown in FIG. 1, the current path is, for example, the following:

$$(11)\rightarrow(16)\rightarrow(13)\rightarrow(6)\rightarrow(3)\rightarrow(2)\rightarrow(6)\rightarrow(14)\rightarrow(16)\rightarrow(12)$$

Mainly, when all glow plugs (1) are also being used for ion flow measurement, this means that a multiple of the current $I_{GK}$ is flowing via the supply voltage terminal (11) and the ground terminal (12), specifically a current $N_z{*}I_{GK}$ increased by a factor $N_2$, the number of cylinders. This results in a very high current loading of these two terminals. For example, for an 8 cylinder engine, at a glow plug current $I_{GK}$=30 A, the total current is 240 A by the two terminals (11) and (12).

The above described conventional system structure for ignition and ion flow measurements has several serious defects.

The glow plugs used for ion flow measurement must be bipolarly connected; a new connector system is necessary on the glow plug. A corresponding plug connector must have two heavy current contacts and is thus clearly more expensive than the unipolar version.

Plugging a bipolar mating connector onto the glow plug mounted in the engine block is more complex than inserting a rotationally symmetrical plug.

Return of the glow plug current to the control device requires a second heavy current line with a large cable cross section with a corresponding plug connection on the control device: Additional costs in the control device and due to the additional cable.

The second heavy current line together with the resulting additional contact points increases the unwanted contact resistances, and thus, reduces the voltage on the glow plug.

In the control device, in addition to the already present heavy current terminal in the positive line (current load: sum of all glow plug currents), which is usually made as a screw terminal, another heavy current terminal in the minus line is necessary: additional costs and additional effort in installation.

SUMMARY OF THE INVENTION

A primary object of the present invention is, therefore, to provide ion flow glow plugs and systems for ignition and ion flow measurement using such glow plugs which overcomes the shortcomings of the prior art.

This object is achieved in accordance with the invention by an ion flow measurement glow plug with an electrical terminal for the ignition current of a heating element which is located in a glow tube in the combustion space, the glow tube being located in a plug housing, insulated relative to the latter, and the plug housing being electrically connected to the engine block, having a solid-state switch integrated or modularly arranged at the terminal-side area of the plug, the solid-state switch being triggered by a control signal, and switching the second terminal of the heating element via the plug housing to the engine block (ground).

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
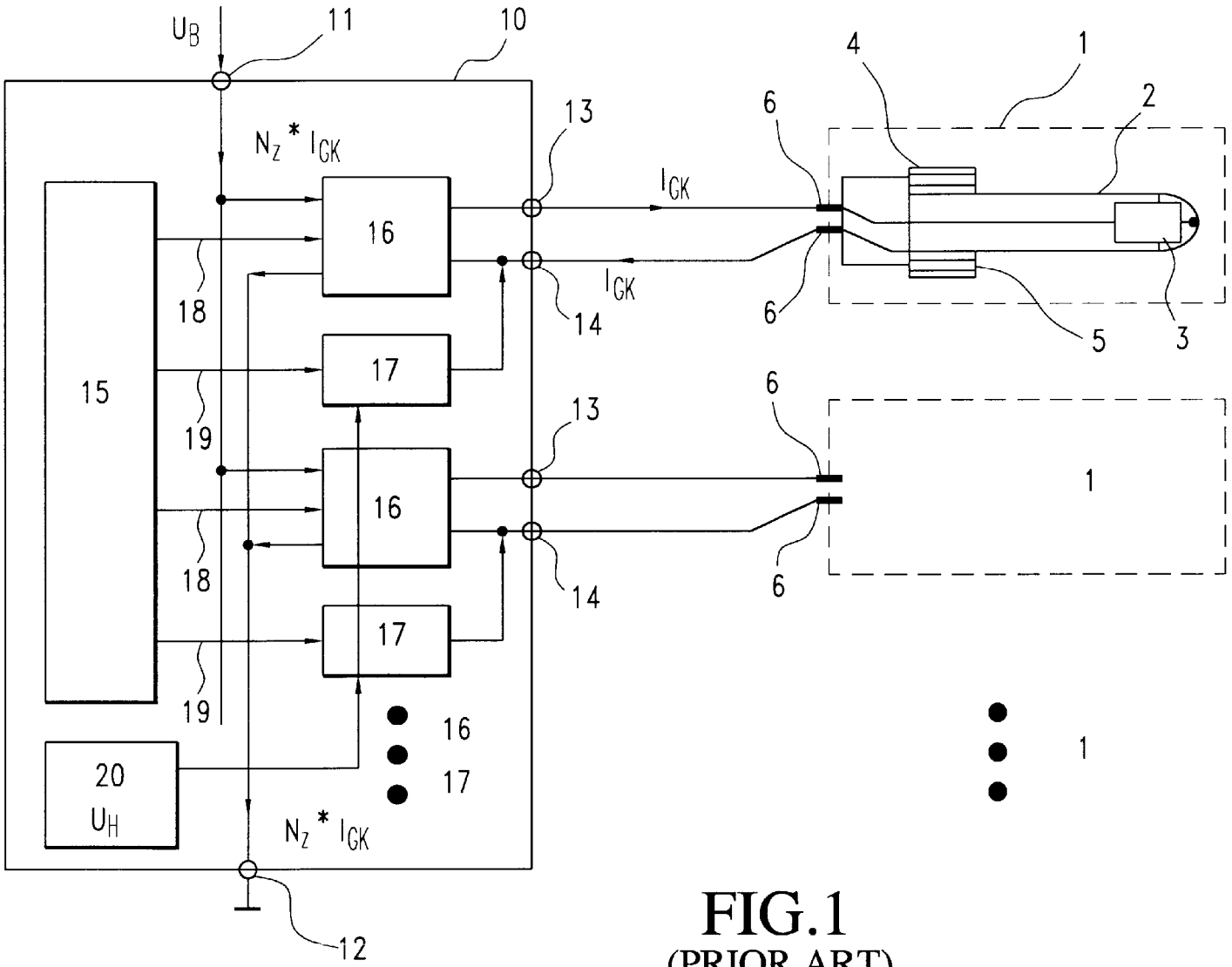
FIG.1 (PRIOR ART)
FIG. 1 is a schematic depiction of a prior art system for ignition and flow measurement.
Figure 3:
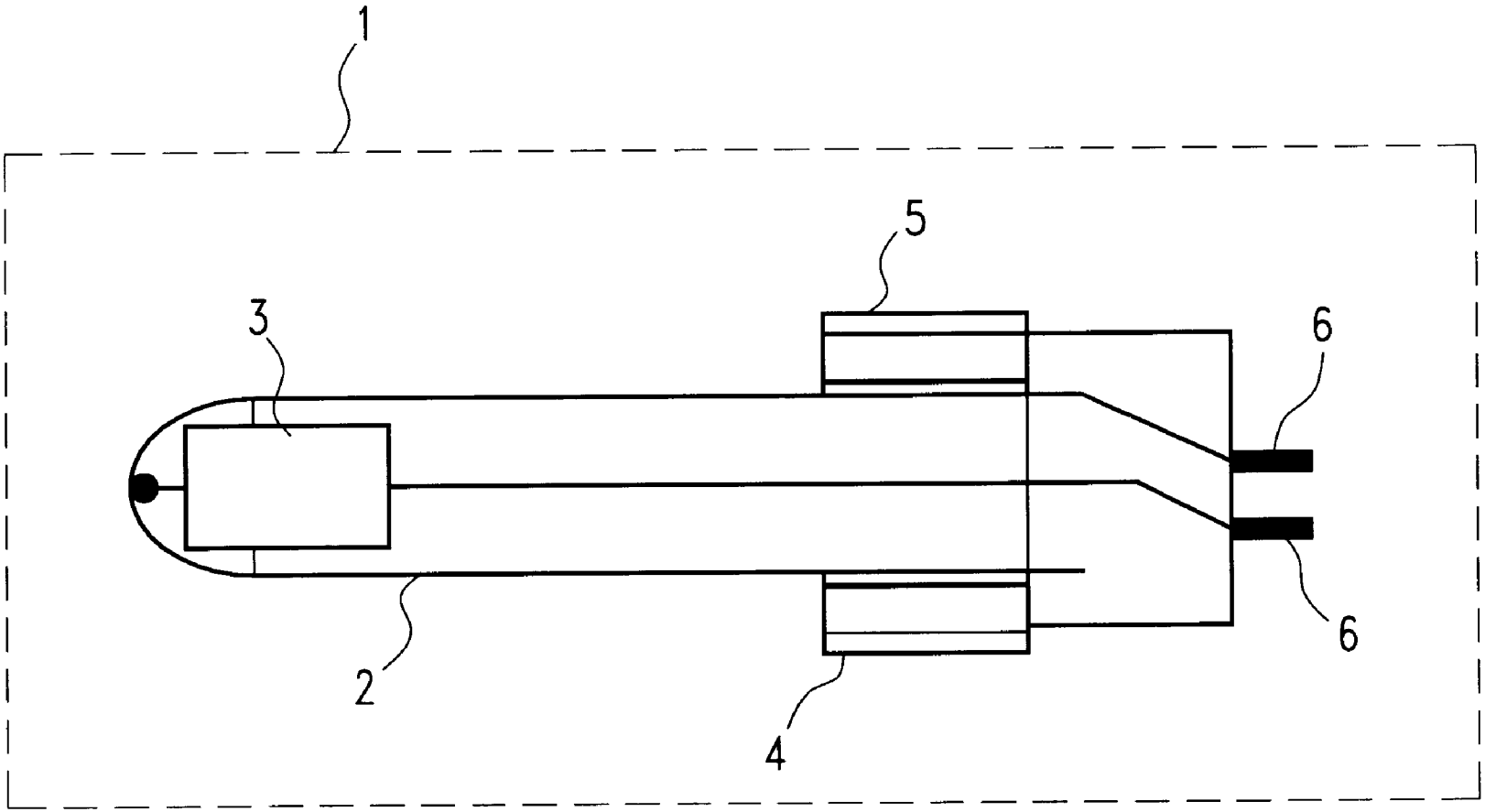
FIG.3 (PRIOR ART)
FIG. 3 shows a prior art bipolar ion flow measurement glow plug.

In the following, the same reference numerals as used in connection with the prior art system and glow plug of FIGS. 1 and 3 is used in connection with the embodiments of the present invention in order to facilitate comparison therebetween.

The system for ignition and ion flow measurement of the present invention is comprised of a control device (10) and a number $N_z$ of glow plugs; $N_z$ is the number of cylinders of the respective engine. One, several or all of the glow plugs are special ion flow measurement glow plugs (1) with either an integrated electronic switch, or an electronic switch that is contained in a module which is plugged onto the glow plugs. The special ion flow measurement glow plugs are connected only unipolarly to the control device (10).

The embodiments of the corresponding glow plugs (1) are explained in greater detail below; in principle, these special ion flow measurement glow plugs (1) are built such that the electrode (2) and the heater (3) are electrically insulated relative to the plug body (4). Furthermore, they contain a solid-state switch (7) and a voltage evaluation circuit (8). These glow plugs have only one electrical terminal (6) for connection to the control device (10). The voltage evaluation circuit (8) evaluates changes of the voltage UGK on the terminal (6) with respect to amplitude or with respect to the time change (for example, ascending or descending flanks) and accordingly triggers the solid-state switch (7).

The control device (10) contains a control unit (15) which controls all functions; preferably, a microprocessor is used here. $N_z$ glow plugs (1) can be connected to the control device (10). For each glow plug (1), there is a switching stage for the ignition current $I_{GK}$ (16) and in addition, when the ion flow is also to be measured with the glow plug, there is a switching stage for ion flow measurement (17). Each glow plug (1) which is also used for ion flow measurement is connected via a terminal (13) to the two switching stages (16) and (17). Each switching stage is triggered by a control signal for the "ignition" (18) function or a control signal for the "ion flow measurement" (19) function. When switching from one function to another, changes with respect to the amplitude and the time change (for example ascending or descending flanks) in the voltage for the ignition current $I_{GK}$ are caused on the glow plug terminal (13), and are then evaluated by the voltage evaluation circuit (8) of the glow plug (1). For ion flow measurement, the electrode (2). and the heater (3) are galvanically separated from the ground terminal (9) by solid-state switch (7) and from the supply voltage terminal (11) by the switching stage (17). At the same time, an auxiliary voltage $U_H$ for ion flow measurement is applied via the switching stage (17) to the glow plug (1) connected as a measurement electrode, and the ion flow measurement is taken.

During the ignition process, the current $I_{GK}$ flows through each switching stage (16) to the individual glow plugs (1), and from there, to the engine block which is at ground potential. For the circuit shown in FIG. 2 the current path is, for example, the following $$(11)\rightarrow(16)\rightarrow(13)\rightarrow(6)\rightarrow(2)\rightarrow(3)\rightarrow(7)\rightarrow(4)\rightarrow(9)$$

This means that, in the control device (10), a multiple of the current $I_{GK}$ is flowing via the supply voltage terminal (11), specifically a current $N_z{*}IG_K$ increased by a factor $N_2$, the number of cylinders. This results in a high current load for this terminal. For example, for an 8 cylinder engine at a glow plug current $I_{GK}$=30 A, the total current is 240 A through the one terminal (11). The terminal (12) is not loaded with this current.

In the following, glow plugs for ion flow measurement are described which can be used in the system described previously, and those which, in combination with a correspondingly adapted control device of the described system, can be used for the same purposes. To do this, for purposes of explanation, FIGS. 4 to 12 are used in which the reference numbers have the following meanings:

(1) Glow plug with electrically insulated heater
(2) Electrode for ion flow measurement, can be made as a closed tube and can contain the heater (3)
(3) Heater, on one side electrically connected anywhere to the electrode (2)
(4) Plug body, electrically insulated relative to the electrode (2)
(5) Electrical insulation
(6) Electrical terminal, current supply
(7) Electrical terminal, control signal
(8) Solid-state switch, for example, n-channel MOS-FET transistor
(9) Voltage evaluation circuit
(10) Resistor
(11) Solid state switch
(12) Switch
(13) Switch
(14) Resistor
(15) Switch module with solid-state switch (8)
(16) Line for current feed
(17) Line for control signal If a glow plug is also to be used for ion flow measurement, in the area of the glow plug tip, a measurement electrode is also required to which an auxiliary voltage $U_H$ is applied. This voltage can be a DC or AC voltage. The voltage $U_H$ is then between the electrode and the inside wall of the cylinder. At this point, if ions are produced by the combustion process, current flows, and its behavior allows conclusions to be drawn regarding the combustion process in the cylinder. Preferably, the glow plug is made such that parts of the heater projecting into the cylinder can also be used as an electrode. That is, the heater and electrode are electrically coupled to one another.

The ion flow measurement glow plug must be connected by two lines to an appropriate control device. The operating current of the glow plug flows via both lines. Since this current is very high, typical values are between 30 and 40 A, the lines and the associated connection means must be made correspondingly massive and thus expensive.

A solid-state switch is integrated as claimed in the invention into the glow plug or into a module plugged onto the glow plug so that the operating current of the glow plug flows via a line; it is even possible, as in conventional glow plugs, to use only a single line for connection of the glow plug.

Figure 4:
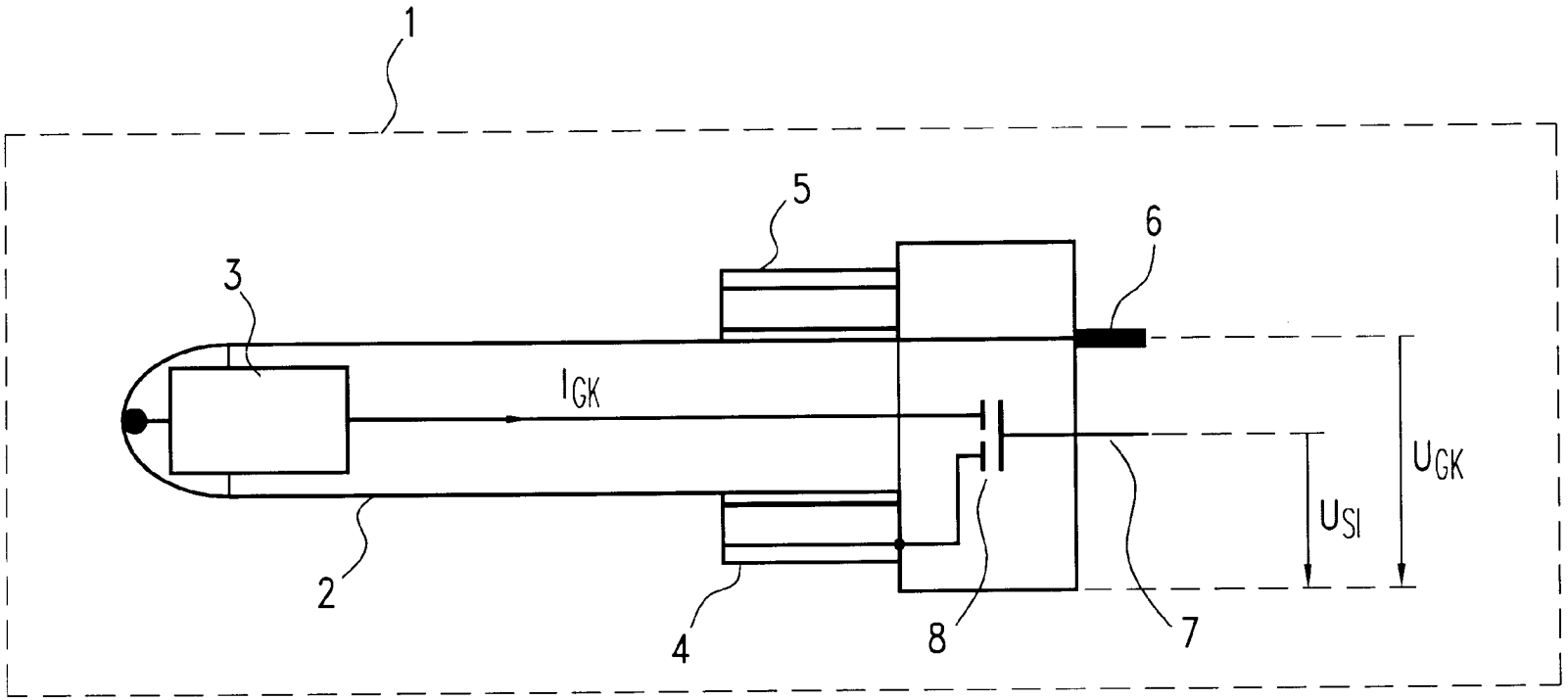
FIG. 4 shows a bipolar ion flow measurement glow plug in accordance with the present invention having an integrated electronic switch.

Conversely, as shown in FIG. 4, an embodiment of a bipolar ion flow measurement glow plug according to the invention with an integrated electronic switch is characterized by the following features: Glow plug (1) with 2 electrical terminals (6) and (7)

The electrode (2) and heater (3) are electrically insulated relative to the engine block by the plug body (4) which contains an insulating element (5)

The electrode (2) is connected anywhere to one of the two terminals of the heater (3)

The ignition current flows via only one electrical terminal (6)

The second electrical terminal (7) carries only one control signal with which a solid-state switch (8) is triggered, which switches the second terminal of the heater (3) via the plug body (4) to the engine block (=ground).

Figure 5:
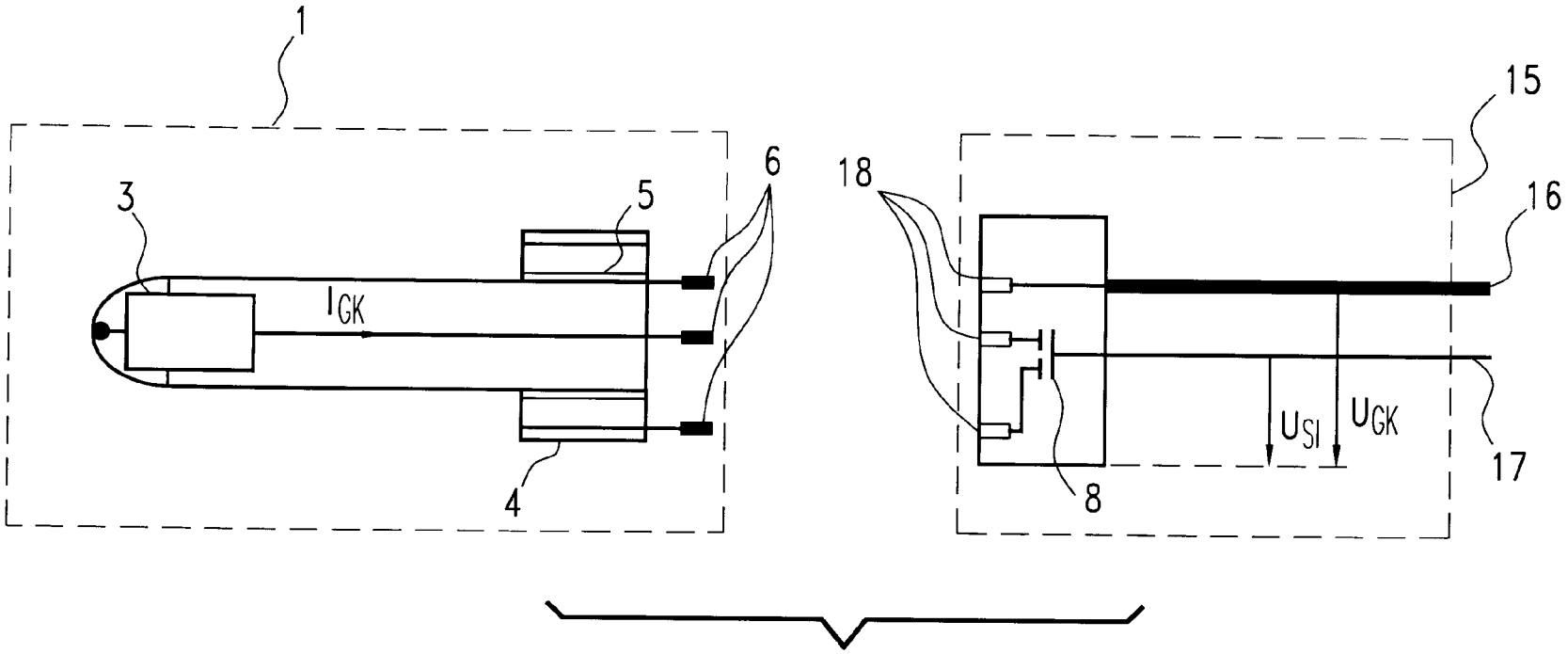
FIG. 5 shows a bipolar ion flow measurement glow plug in accordance with an embodiment of the present invention with a plugged-on electronic switch.

Another embodiment of the bipolar ion flow measurement glow plug in accordance with the invention with an electronic switch plugged on has the following features as shown in FIG. 5:

Glow plug (1) with 3 electrical terminals (6)

The switching module (15), which can be plugged onto the glow plug (1), with an electronic switch (8) having two lines, one for power feed (16) and one for a control signal (17), and connectors (18) which mate with the terminals (6)

The electrode (2) and heater (3) are electrically insulated relative to the engine block by the plug body (4) which contains an insulating element (5)

The electrode (2) is connected anywhere to one of the two terminals of the heater (3)

The ignition current flows via only one electrical line (16)

The second electrical line (17) carries only a control signal with which a solid-state switch (8) is triggered, which switches the second terminal of the heater (3), via the plug body (4), to the engine block (=ground).

Figure 6:
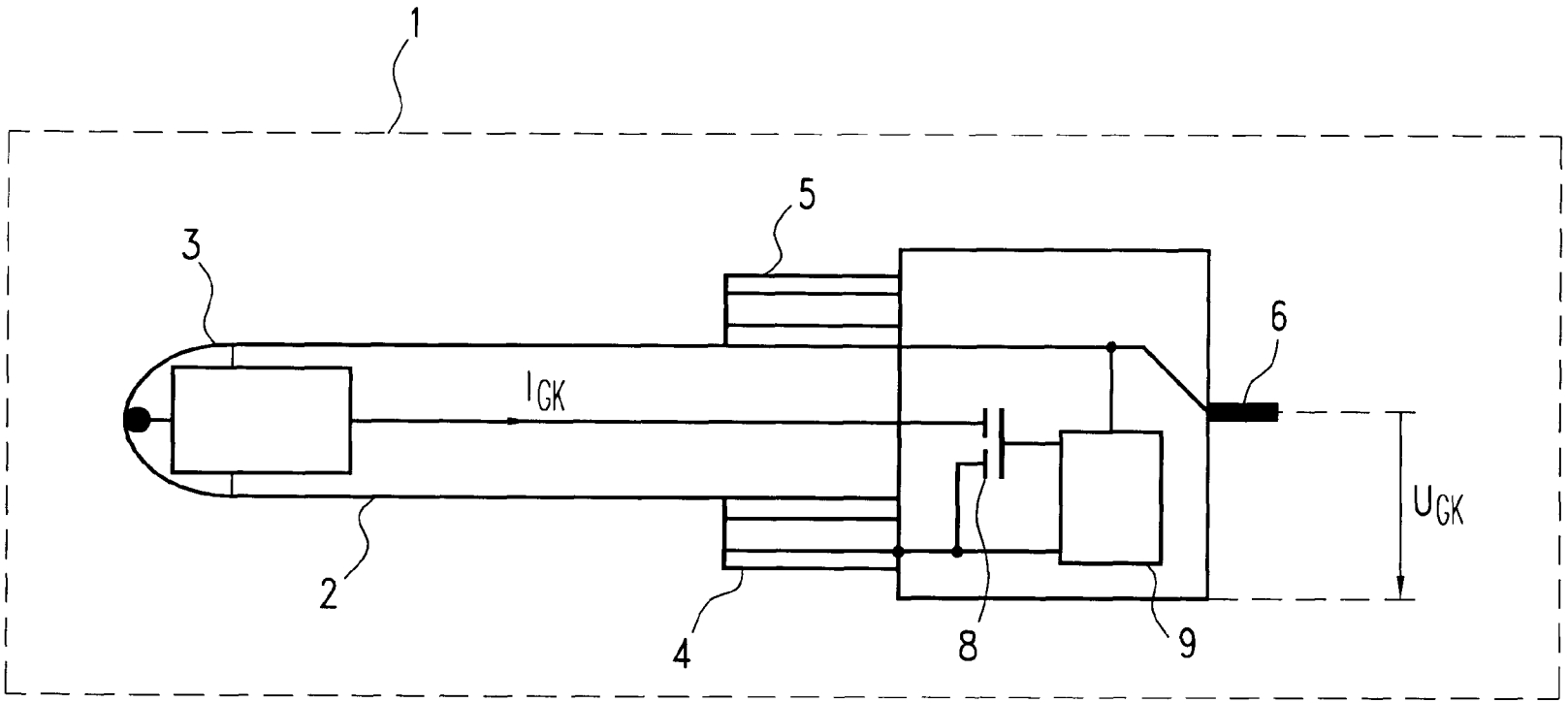
FIG. 6 shows a unipolar ion flow measurement glow plug in accordance with another embodiment of the present invention having a plugged-on electronic switch.

Another embodiment of a unipolar ion flow measurement glow plug according to the invention with an electronic switch plugged on has the following features, as shown in FIG. 6:

Glow plug with one electrical terminal (6)

The electrode (2) and heater (3) are electrically insulated relative to the engine block by the plug body (4) which contains an insulating element (5)

The electrode (2) is connected anywhere to one of the two terminals of the heater (3)

The voltage on the electrical terminal (6) is evaluated and a solid-state switch (8) is triggered which switches the second terminal of the heater via the plug body (4) to the engine block (=ground).

Figure 7:
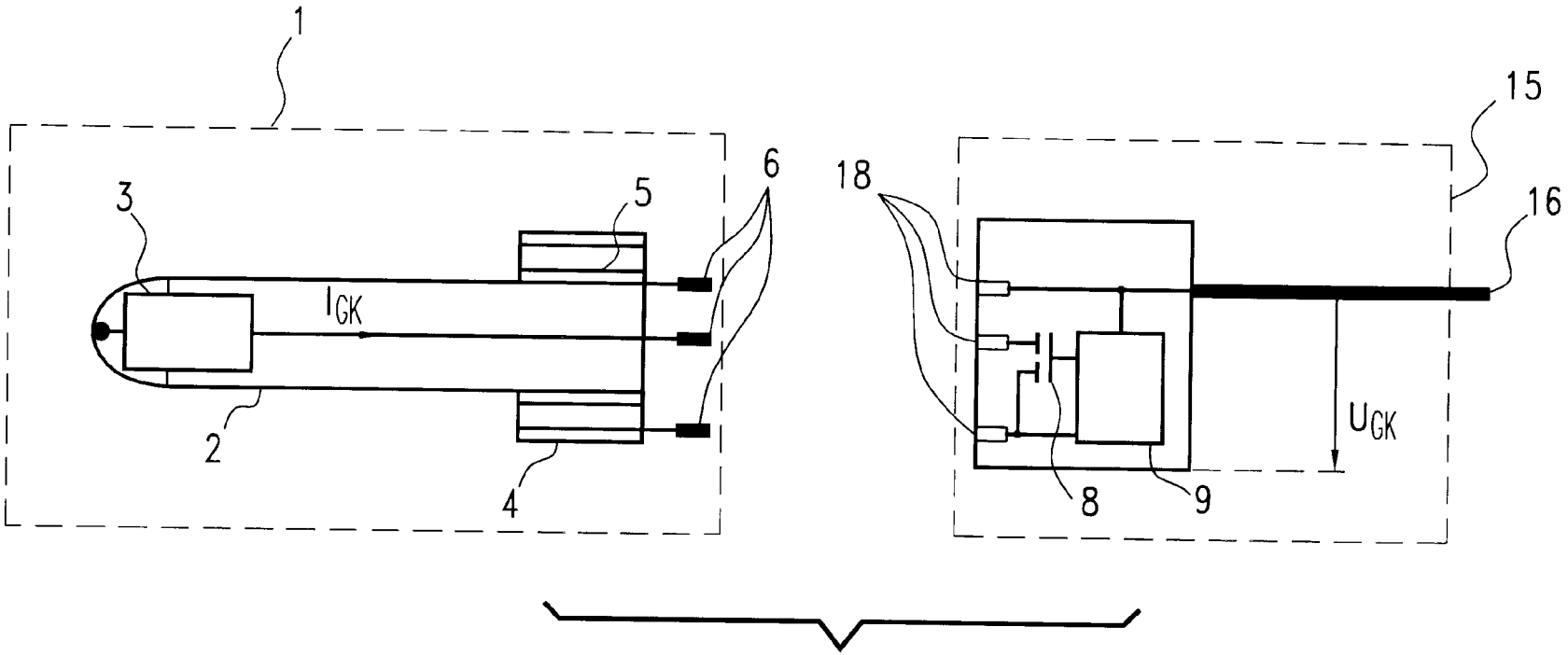
FIG. 7 shows a unipolar ion flow measurement glow plug in accordance with a further embodiment of the present invention having a plugged-on electronic switch.

Another embodiment of a unipolar ion flow measurement glow plug in accordance with the invention with a plugged-on electronic switch is characterized by the following features as shown in FIG. 7:

Glow plug (1) with 3 electrical terminals (6)

Switching module (15) which can be plugged onto the glow plug (1) with an electronic switch (8) with one line for power feed (16) and mating connectors (18) to the terminals (6)

The electrode (2) and heater (3) are electrically insulated relative to the engine block by the plug body (4) which contains an insulating element (5)

The electrode (2) is connected anywhere to one of the two terminals of the heater (3)

The voltage on the electrical terminal (16) is evaluated and a solid-state switch (8) is triggered which switches the second terminal of the heater, via the plug body (4), to the engine block (=ground).

Figure 8:
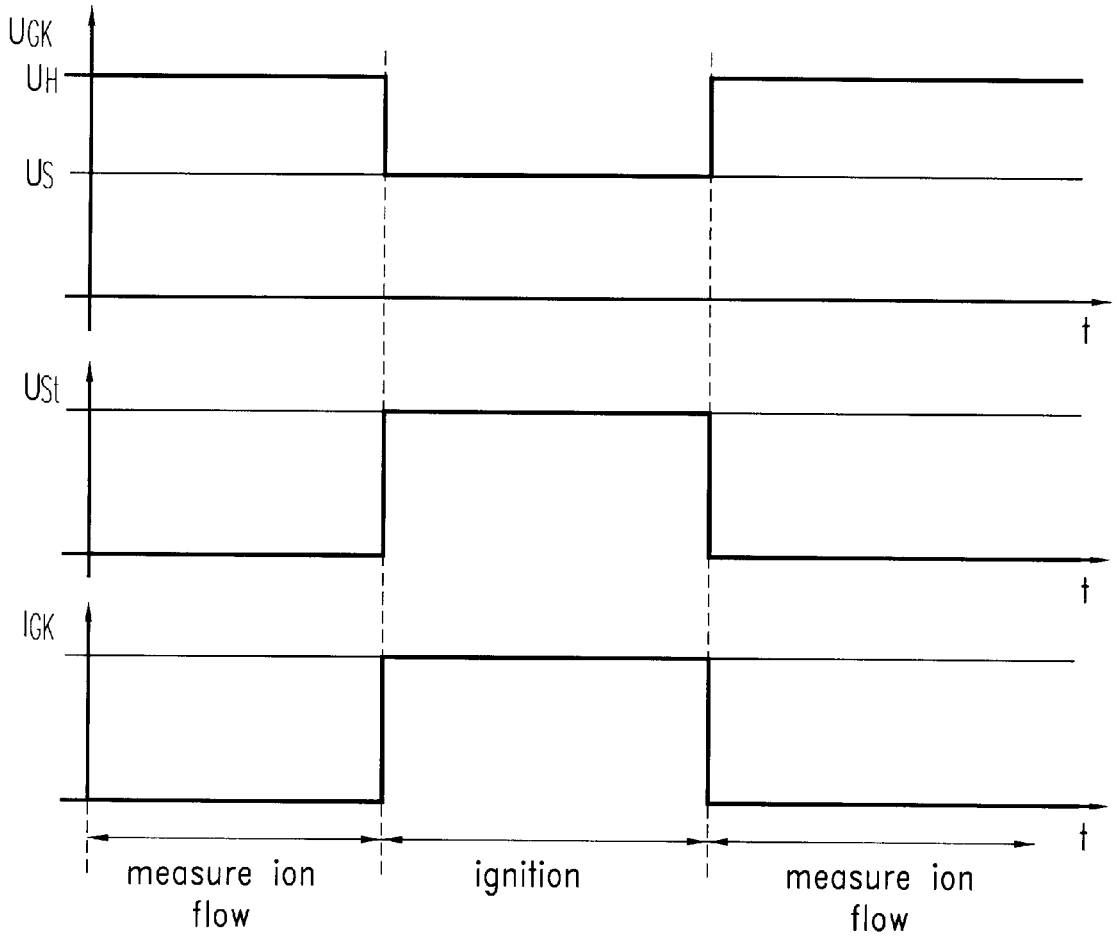
FIG. 8 is a depiction of the electrical behavior of a bipolar ion flow measurement glow plug in accordance with the present invention.

In the following, the electrical behavior of a bipolar ion flow measurement glow plug according to the invention with an electronic switch is described using FIG. 8:

If a voltage $U_{St}$ is applied to the terminal (7) or (17) and it is sufficient to forcibly trip the solid-state switch (8) (for example, $U_{St}$=5 . . . 10 V), then, if a voltage $U_{GK}=U_B$ is on the terminal (6) or (16), a current can flow from the terminal (6) or (16) through the electrode (2) and the heater (3), and the solid-state switch (8) to the plug body (4) which is at ground, FIG. 8. If the solid-state switch (8) is blocked, a voltage $U_{GK}=U_H$, for example, where $U_H>U_B$, can be applied to the terminal (6) or (16) for ion flow measurement. The voltage $U_H$ can be a DC or AC voltage, ion flow measurement being possible whenever there is no glow.

In the following, the electrical behavior of a unipolar ion flow measurement glow plug is described using FIG. 9:

Version 1: $U_H > U_B$

For ion flow measurement, an auxiliary voltage $U_H$ is used which is clearly greater than the vehicle electrical system voltage UB, for example, $U_B$=14 V, $U_H$=40 V. The voltage $U_H$ can be a DC or an AC voltage. A voltage evaluation circuit (9) which contains a threshold detector (comparator) with the operating threshold Us is connected upstream of the solid-state switch (8) and forcibly trips the solid-state switch (8) depending on the voltage $U_{GK}$ on the terminal (6) or (16) and the plug body (4), $U_{GK} \approx U_B$, or blocks it, $U_{GK} \approx U_H$. If $U_H$ is an AC voltage, preferably the amplitude or the effective value of the voltage will be evaluated. The operating point $U_S$ will be chosen such that it is greater than $U_B$ and less than $U_H$:

$$U_B < U_S < U_H$$

Figure 9:
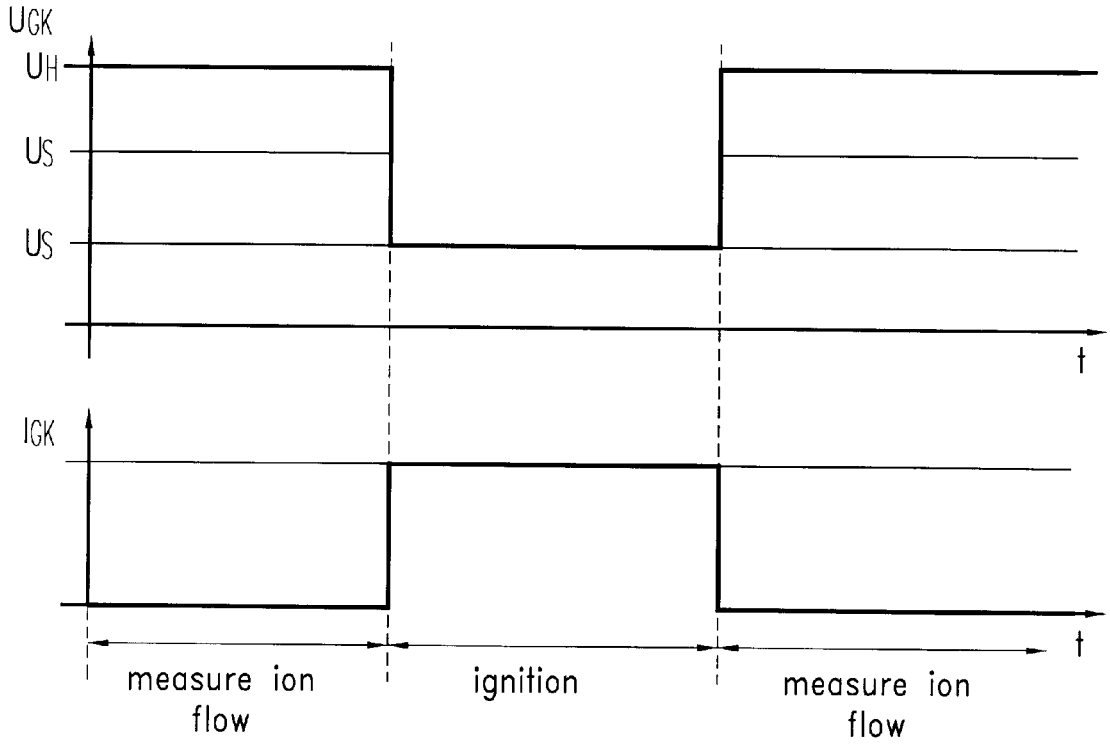
FIG. 9 is a depiction of the electrical behavior of a unipolar ion flow measurement glow plug.
Figure 10:
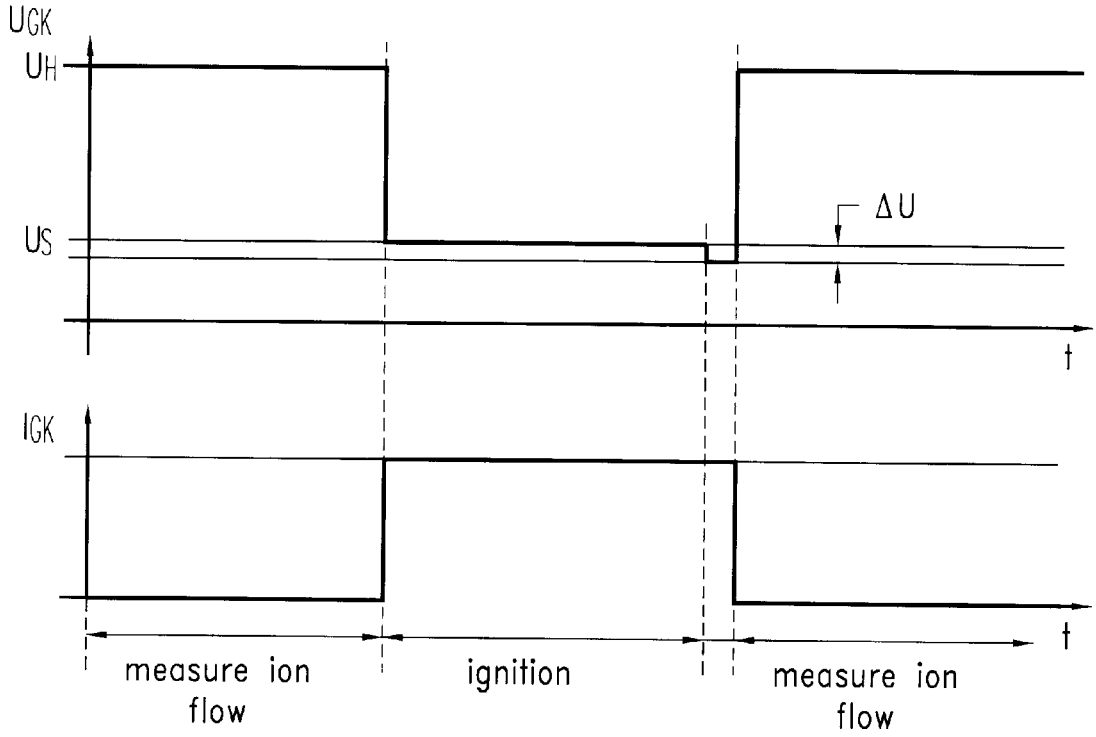
FIG. 10 is a depiction of the conditions under which the solid-state switch is forcibly tripped.
Figure 11:
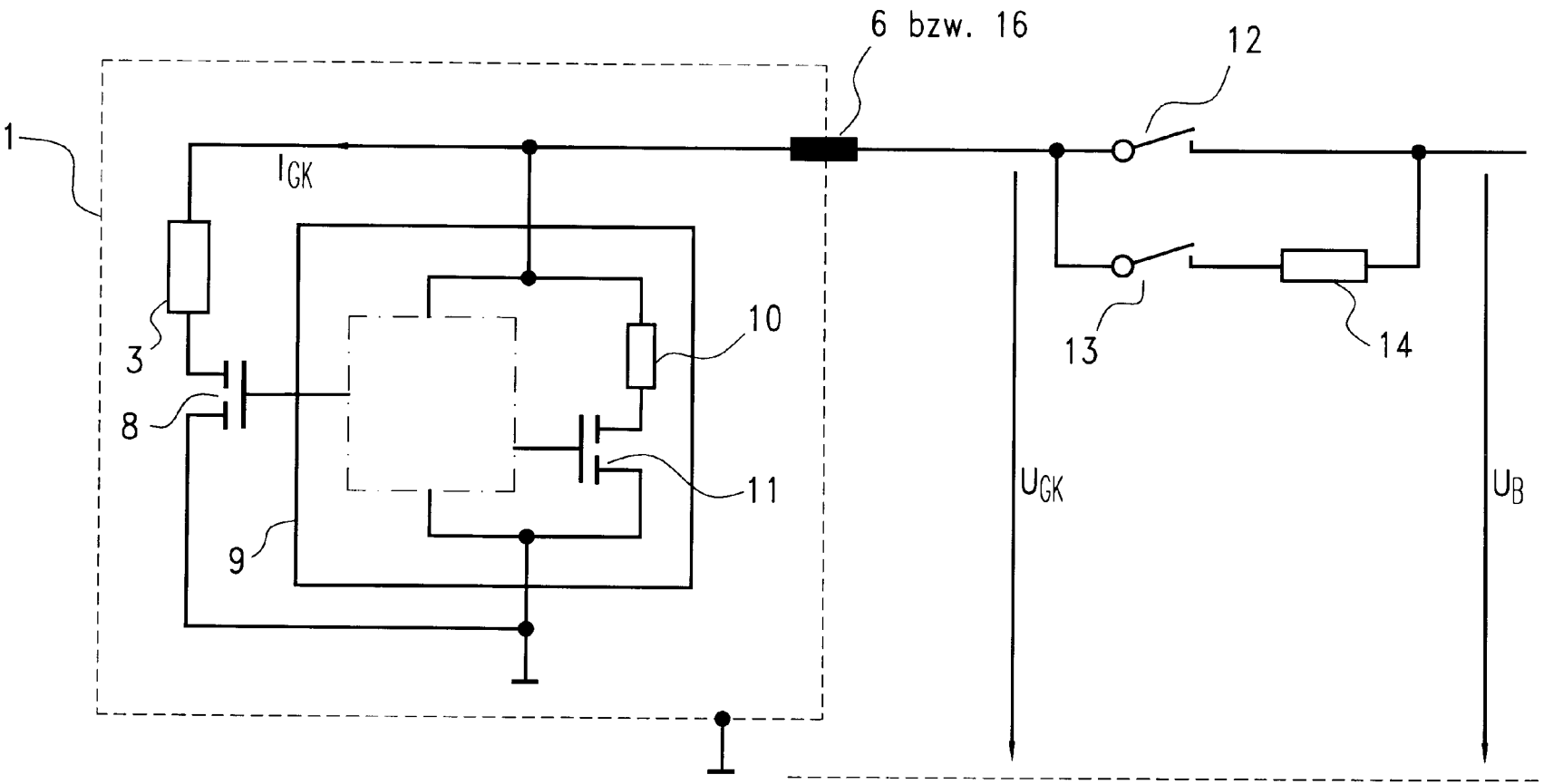
FIG. 11 schematically shows an arrangement by which the vehicle electrical system voltage is used for ion flow measurement.

For $U_{GK} < U_S$, the solid-state switch (8) is forcibly tripped and a current can flow from the terminal (6) or (16) through the electrode (2) and the heater (3), and the solid-state switch (8) to the plug body (4) at ground, FIG. 9. If the solid-state switch (8) is blocked, $U_{GK} = U_H$, the voltage $U_H$ is on the terminal (6) or (16) for ion flow measurement. That is, ion flow measurement is possible whenever there is no glow.

Version 2: $U_H > U_B$

For ion flow measurement, an auxiliary voltage $U_H$ is used which is clearly greater than the vehicle electrical system voltage $U_B$, for example, $U_B$=14 V, $U_H$=40 V. The voltage $U_H$ can be a DC or an AC voltage. A voltage evaluation circuit (9) which evaluates the voltage changes of $U_{GK}$ is connected upstream of the solid-state switch (8). This circuit forcibly trips the solid-state switch (8) depending on the changes of the voltage $U_{GK}$ on the terminal (6) or (16) and the plug body (4). If $U_H$ is an AC voltage, preferably the amplitude or the effective value of the voltage will be evaluated. If $U_{GK}$ changes from the higher voltage $U_H$ towards voltage $U_B$, the solid-state switch (8) is forcibly tripped, see FIG. 10. If $U_{GK}$ is at the level of $U_B$ and then $U_{GK}$ is reduced by the voltage value $\Delta U$, for example, $\Delta U \approx 0.5$ V, the solid-state switch (8) is blocked. As a reaction, the voltage $U_{GK}$ then increases again to $U_H$.

If the solid-state switch (8) is forcibly tripped, a current can flow from the terminal (6) or (16) through the electrode (2) and the heater (3), and the solid-state switch (8) to the plug body (4) at ground. If the solid-state switch (8) is blocked, $U_{GK} = U_H$, the voltage $U_H$ is on the terminal (6) or (16) for ion flow measurement, so that ion flow measurement is possible whenever there is no glow.

Version 3: $U_H = U_B$

For ion flow measurement, a higher auxiliary voltage UH is not needed; the vehicle electrical system voltage $U_B$ can be used, $U_H = U_B$. The voltage $U_B$ can be a DC or an AC voltage. The voltage $U_B$ can be switched via low-resistance or via the switch (13) and the resistor (14) to the terminal (6) or (16) of the glow plug, see FIG. 11. A voltage evaluation circuit (9) which contains a threshold detector (comparator) with an operating point $U_S$, a resistor (10) and another solid-state switch (11) is connected upstream of the solid-state switch (8). If the solid-state switch (11) is conductive, the resistor (10) is connected between the ground and the terminal (6) or (16).

If via the switch (12) or (13) the voltage $U_B$ is connected to the terminal (6) or (16) of the glow plug (1), first of all, the solid-state switch (11) is conductive. When the switch (12) is turned on, the voltage UGK on the terminal (6) or (16) is equal to the voltage $U_B$. Conversely, if switch (13) is turned on, the resistors (10) and (14) form a voltage divider and the voltage $U_{GK}$ on the terminal (6) or (16) is less than the voltage $U_B$. For example, if the same values are chosen for the resistors (10) and (14), for the voltage on the terminal (6) or (16) we find:

$$U_{GK} = U_B / 2$$

The operating point $U_S$ is chosen such that it is between the voltage determined by the voltage divider formed by the resistors (10) and (14), and the voltage $U_B$. For an embodiment with the resistor (10) equal to the resistor (14), for $U_S$, the following is preferably chosen:

$$U_S = 3/4 * U_B$$

Figure 12:
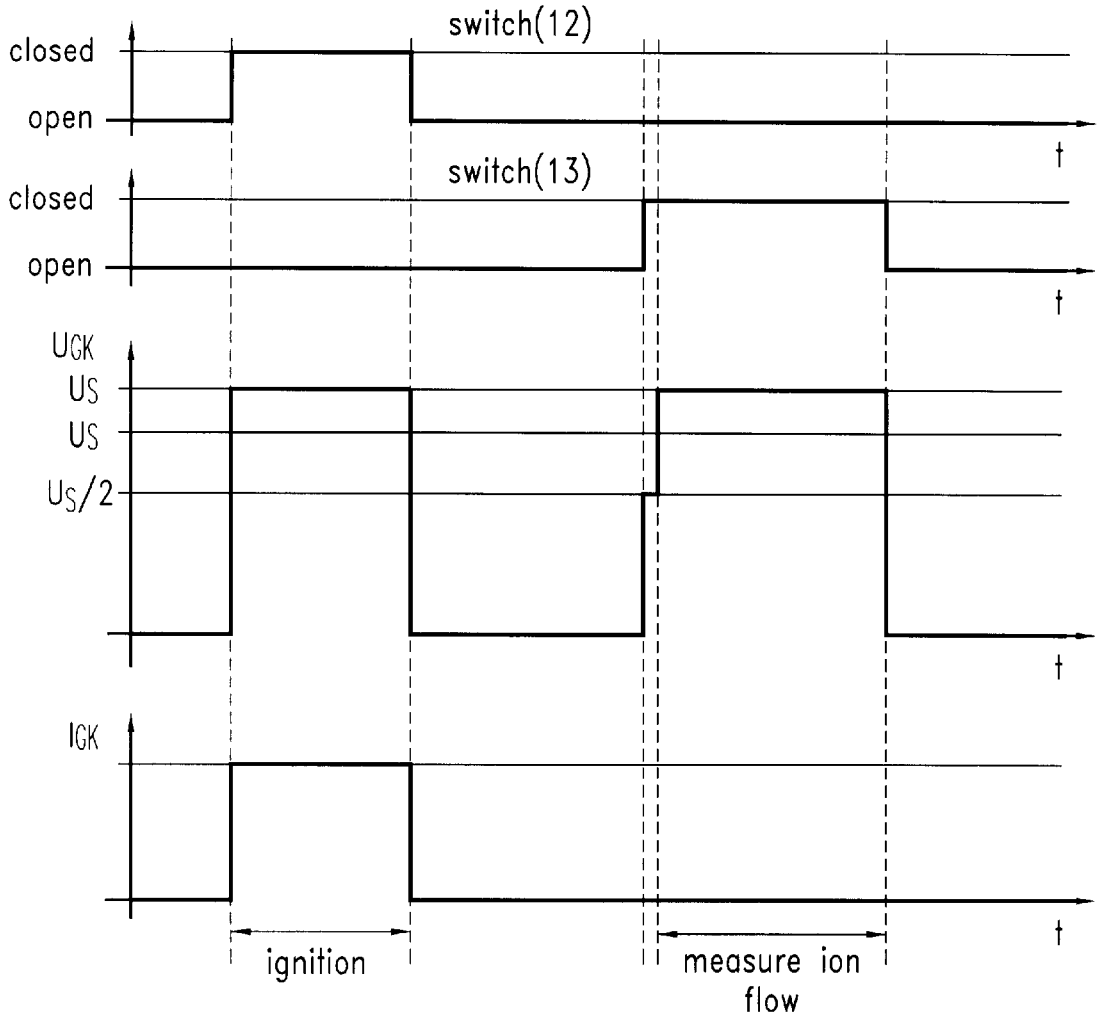
FIG. 12 is a depiction of the conditions under which the solid-state switch is triggered using the FIG. 11 arrangement.

The voltage evaluation circuit (9) evaluates the voltage $U_{GK}$ shortly after applying a voltage to the terminal (6) or (16) and triggers the solid-state switches (8) and (11) accordingly, see FIG. 12:

Case 1: $U_{GK} = U_B / 2$ The solid-state switch (8) remains blocked, the solid-state switch (11) is blocked after evaluation of the voltage on the terminal (6) or (16)

Case 2: $U_{GK} = U_B$ The solid-state switch (8) is switched conductively, the solid-state switch (11) is blocked after evaluation of the voltage on the terminal (6) or (16)

Figure 2:
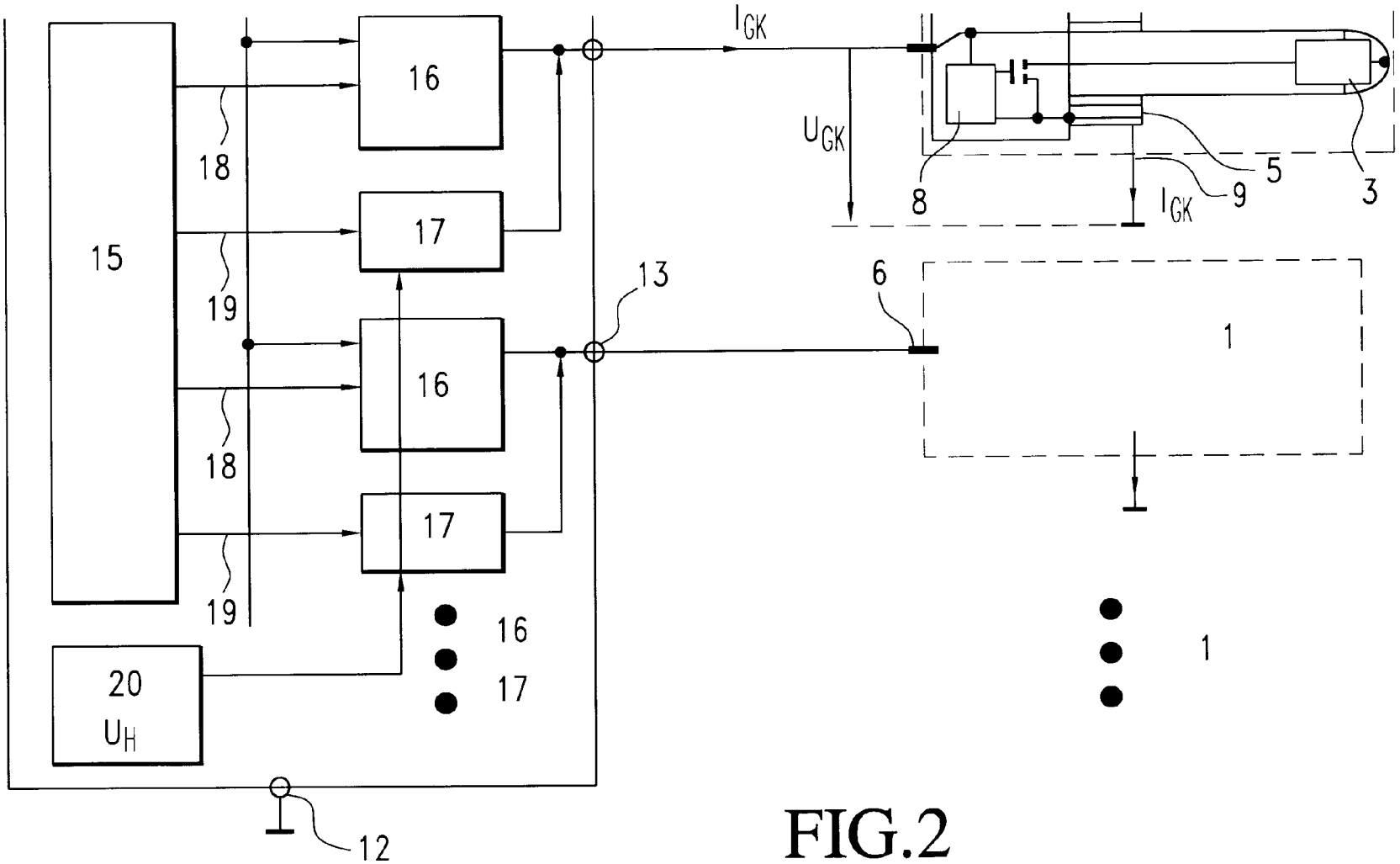
FIG. 2 is a schematic depiction of a system for ignition and flow measurement in accordance with the present invention.

For $U_{GK} = U_B > U_S$, the solid-state switch (8) is forcibly tripped and a current can flow from the terminal (6) or (16) through the electrode (2) and the heater (3), and the solid-state switch (8) to the plug body (4) which is at ground, see also FIG. 2. The current flowing through the resistor (10) can be ignored relative to the current $I_{GK}$ flowing through the heater (3).

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Ion flow measurement glow plug with an electrical terminal for receiving glow plug current for a beating element which is located in a glow tube on an end directed toward a combustion space of an engine block in use, the glow tube being located in a plug housing, insulated relative to the plug housing, and the plug housing, in use, being electrically connected to ground; wherein a solid-state switch is integrated into a terminal end area of the plug, the switch being triggerable by a control signal and switching a ground terminal of the heating element, via the plug housing, to ground.

2. Glow plug as claimed in claim 1, wherein the glow plug has a second electrical terminal which carries only said control signal.

3. Glow plug as claimed in claim 2, wherein the electronic switch is located in a switching module which is plugged onto the glow plug, the switching module having an electrical terminal for the glow plug current and an electrical terminal for the control signal and connectors for mating with the terminal of the plug which receives glow plug current for the heating element.

4. Glow plug as claimed in claim 1, wherein there is only one electrical terminal for power supply, said one electrical terminal being connected to a voltage evaluation circuit via which the solid-state switch is triggered.

5. Glow plug as claimed in claim 4, wherein the electronic switch is located in a switching module which is plugged onto the glow plug, the switching module having an electrical terminal for the glow plug current and an electrical terminal for the control signal and connectors for mating with the terminal of the plug which receives glow plug current for the heating element.

6. Control device for triggering at least one glow plug with an electrical terminal for receiving glow plug current for a heating element which is located in a glow tube on an end directed toward a combustion space of an engine block in use, the glow tube being located in a plug housing, insulated relative to the plug housing, and the plug housing, in use, being electrically connected to ground; wherein a solid-state switch is arranged at a terminal end area of the plug, the switch being triggerable by a control signal from the control device and switching a second terminal of the heating element, via the plug housing, to ground in response thereto.

7. Arrangement for glow plug current and ion flow measurement, comprising a control device and at least one glow plug with an electrical terminal for receiving glow plug current for a heating element which is located in a glow tube on an end directed toward a combustion space of an engine block in use, the glow tube being located in a plug housing, insulated relative to the plug housing, and the plug housing, in use, being electrically connected to ground; wherein a solid-state switch is arranged at terminal end area of the plug, the switch being triggerable by a control signal the control device and switching a second terminal of the heating element, via the plug housing, to ground in response thereto.

* * * * *